United States Patent [19]

Schmeising

[11] Patent Number: 4,895,092

[45] Date of Patent: Jan. 23, 1990

[54] MAINSAIL FURLING DEVICE FOR A SAILBOAT

[76] Inventor: Henry F. Schmeising, 144-19 72nd Ave., Flushing, N.Y. 11367

[21] Appl. No.: 285,213

[22] Filed: Dec. 16, 1988

[51] Int. Cl.[4] ..... B63H 9/04

[52] U.S. Cl. ..... 114/104; 114/39.1

[58] Field of Search ..... 114/89, 102, 104, 105, 114/39.1

[56] References Cited

U.S. PATENT DOCUMENTS 4,280,431 7/1981 Sofen ..... 114/105

4,347,799 9/1982 Moriarty ..... 114/102

FOREIGN PATENT DOCUMENTS 1492042 7/1967 France ..... 114/104

*Primary Examiner*—Joseph F. Peters, Jr.

*Assistant Examiner*—Jesüs D. Sotelo

*Attorney, Agent, or Firm*—Michael I. Kroll

[57] ABSTRACT

A mainsail furling device for a sailboat having a boom comprising a plurality of pairs of mounting brackets attached to the boom, each of the mounting brackets having a substantially L-shaped cross section and two connected approximately rectangular bracket panels, a substantially flat mainsail retaining arm pivotally attached to each mounting bracket pivotable between a position folded against the boom and a deployed position substantially perpendicular to the boom, a device for pivotally mounting each mainsail retaining arm on its mounting bracket comprising a threaded bolt and nut and a device for securing each of the mainsail retaining arms in its deployed position substantially perpendicular to the boom.

5 Claims, 2 Drawing Sheets

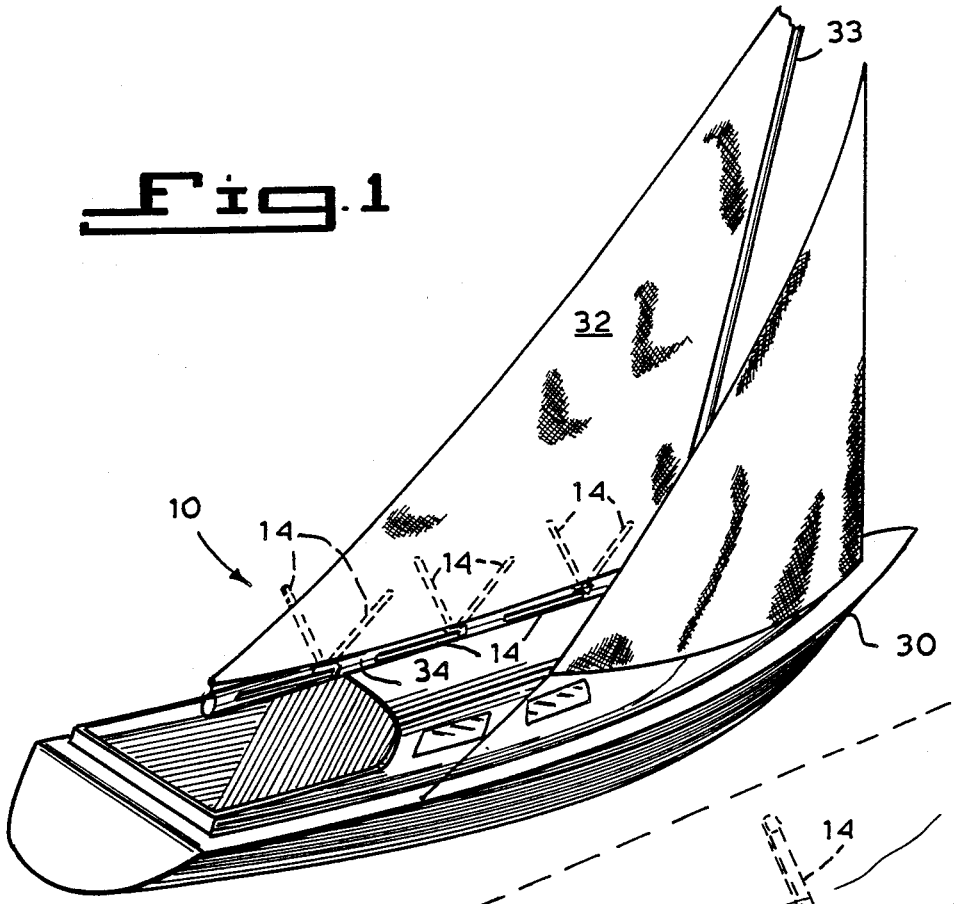
Fig. 1
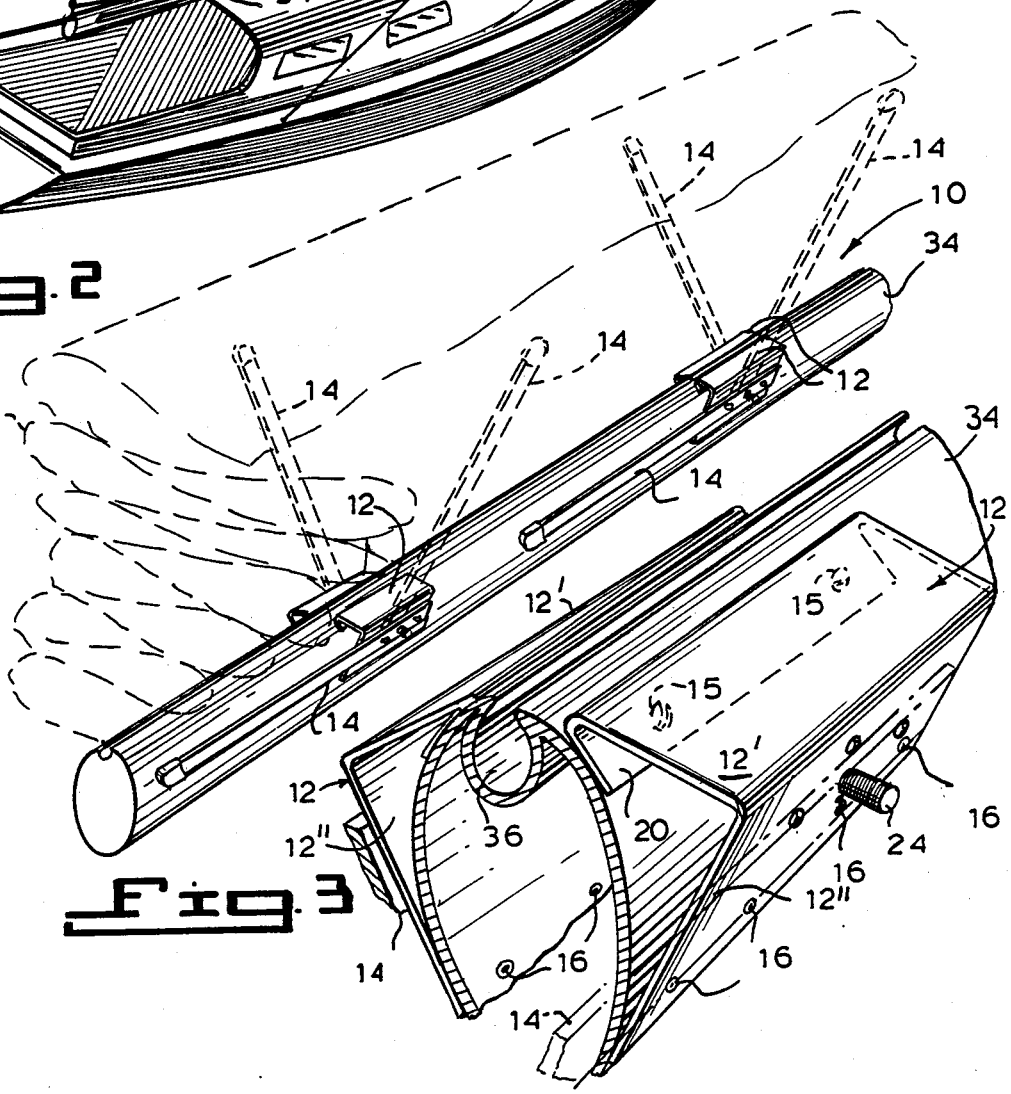
Fig. 2
Fig. 3

MAINSAIL FURLING DEVICE FOR A SAILBOAT

THE FIELD OF THE INVENTION

The instant invention relates to a device which helps to furl a sail of a sailboat, particularly the mainsail of a sloop or other sail rigged on a boom attached to a mast.

THE BACKGROUND OF THE INVENTION

The weekend sailor of a recreational sailboat is often constantly confronted with a shortage of time for boating because of work and family obligations. It is therefore desirable to shorten the time required to begin a particular sailing voyage, i.e. the time required to travel from the sailor's home to the sailboat and the time required to rig the boat or put the boat in the water.

The time spent rigging the sails of a sloop or other small boat can involve any of a number of procedures from stepping the mast of the boat, which is rarely done each time the sailboat is used, to bending on the mainsail on the boom of a sailboat which is moored or at a slip in a harbor.

In the case of a comparatively small sloop under about eighteen feet the mainsail is often stored between sailing outings in a sailbag. This is done by reversing the steps used to bend on the mainsail, removing the sail from the boom and the mast, properly folding it and then storing it in the sailbag. This procedure is of course too time-consuming if one simply wishes to lower the sail because the wind has become too heavy and use an auxiliary motor to power the sailboat while contemplating using the mainsail again when the wind has died. That is also true when one wishes to temporarily lower the mainsail while making a stop at an intermediate location for recreational purposes or to take on food or fuel. Then the mainsail may be temporarily stored by easing up on the main halyard, cranking or pulling the mainsail downward and sliding the entire luff rope or other attaching means for the luff of the main from the slot in the aft portion of the mast. The mainsail then may be simply wrapped temporarily around the boom after disconnecting the main halyard. Later all that is required is that the main halyard be reattached to the eye in the headboard, the luff of the mainsail be reconnected to the slot in the aft of the mast and the mainsail be raised. However this method of temporary storage is inconvenient and somewhat dangerous. The mainsail can flop around somewhat when wrapped around the boom especially if this is done rapidly and can be impaired or even damaged by tearing. This is especially true if it is incompletely wrapped around the boom.

An even more rapid method of temporarily storing a mainsail on the boom of a sloop to make a temporary stop or to wait for the wind to die down is based on a modification of the typical mainsail. A plurality of grommets having plastic slugs fitting in the slots of the boom and the mast are attached at the edge of the foot and the luff of the mainsail spaced from each other. The bending on of the mainsail occurs by sliding the slugs on the foot in the mainsail in the slot in the boom and attaching the boom downhaul, attaching the halyard to the eye in the headboard and then raising the main part of the way sliding the plastic slugs in the aft slot in the mast. Stops are then installed at the end of the slots in the boom and the mast which prevent the plastic slugs from sliding from the slots. Cloth gasket tiedowns can then be used to secure the mainsail to the boom for storage but the main halyard remains attached during storage and the luff of the main remains attached to the mast so that a very rapid raising and lowering of the main can be made. The disadvantages of this method are that installation is somewhat complicated and expensive additional work is required by a sail maker. Furthermore when the sail is finally taken from the boom and the mast for winter storage or repair reinstallation is time-consuming and tedious. Thus the method is not very desirable for trailered sailboats which are put in and out of the water each weekend.

It is an object of the invention to provide a device which assists in rapid temporary storage of the mainsail of a slope on its boom while the main halyard remains attached to the mainsail and the mainsail remains attached to the mast but which does not require expensive and time-consuming special modifications of the mainsail.

It is another object of the invention to provide a device which assists in rapid temporary storage of the mainsail of a slope on its boom while the main halyard remains attached to the mainsail and the mainsail remains attached to the mast but which does not require complicated and time-consuming special procedures for installation or removal of the sail from the mast and/or the boom.

It is a general object of the invention to provide a device which assists in rapid temporary storage of the mainsail of a slope on its boom while the main halyard remains attached to the mainsail and the mainsail remains attached to the mast but which is both economical and simple to install.

SUMMARY OF THE INVENTION

According to our invention a mainsail furling device for a mainsail of a sailboat having a boom comprises a plurality of pairs of mounting brackets attached to the boom of the sailboat spaced from each other on the boom, a mainsail retaining arm pivotally attached to each of the mounting brackets pivotable between a position folded against the boom and a deployed position substantially perpendicular to the boom, a means for pivotally mounting each mainsail retaining arm and a means for securing each mainsail retaining arm in a deployed position substantially perpendicular to the boom.

Each of the mounting brackets can have a substantially L-shaped cross section with two approximately rectangular bracket panels connected to each other substantially perpendicularly. The shorter of the two bracket panels can advantageously have a folded-under flange portion with screw holes for securing the mounting bracket nondetachably to the boom and the free end of the longer of the two bracket panels can be attached nondetachably to the boom substantially parallel to the boom longitudinal direction.

The means for pivotally mounting each of the arms on the mounting bracket can comprise a threaded bolt passing through the longer bracket panel and the sail retaining arm and a nut engaged with the threaded bolt pressing the sail retaining arm on the mounting bracket.

In one embodiment of the invention the means for securing the sail retaining arm in an upwardly extended position substantially perpendicular to the boom comprises at least one spring-loaded ball mounted in a cavity in the mainsail retaining arm and a hole or recess in the mounting bracket positioned to receive the spring-loaded ball when the sail retaining arm is pivoted into the upwardly extended position.

In another embodiment of the invention the means for securing the sail retaining arm in an upwardly extended position substantially perpendicular to the boom comprises two holes or recesses provided in the mounting bracket on opposite sides of the means for pivotal attachment of the sail retaining arm and two catch pins protruding through the sail retaining arm on opposite sides of the means for pivotal attachment positioned to engage the holes or recesses when the sail retaining arm is in the upwardly extended position.

The mainsail furling device for a mainsail of a sloop or other sailboat having a boom-mounted mainsail may be rapidly and easily installed on a sailboat boom. Without expensive or time-consuming modifications of the mainsail it can be used to rapidly furl and secure the mainsail for a temporary stop in the voyage of the sailboat or to secure the sail in heavy weather. The sail is rapidly and easily stowed without detaching the main halyard or removing the luff of the main from the mast.

BRIEF DESCRIPTION OF THE DRAWING FIGURES

FIG. 1 is a perspective view of a mainsail furling device according to the instant invention shown installed on the boom of a sloop.

FIG. 2 is cutaway perspective view of a portion of the mainsail furling device of FIG. 1 with the mainsail furling device shown in greater detail.

FIG. 3 is a detailed partially cross sectional, cutaway partially perspective view of a portion of a boom with the mounting brackets for the mainsail furling device of FIG. 1 attached.

DETAILED DESCRIPTION OF THE INVENTION

Figure 4:
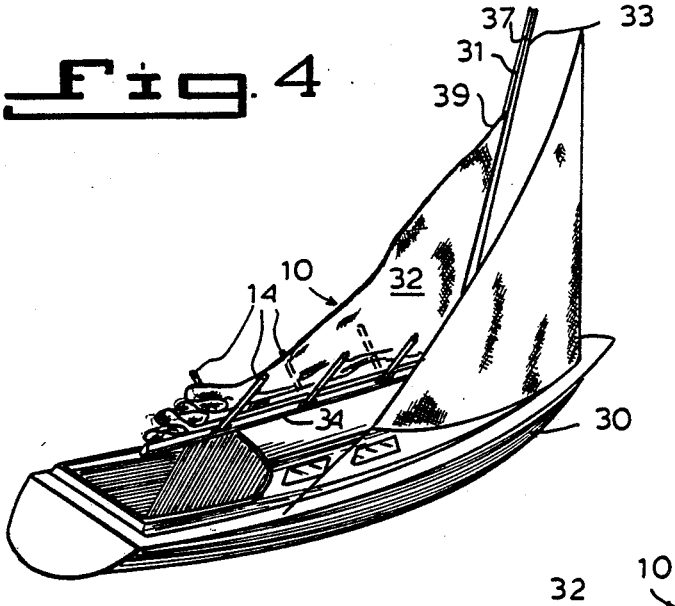
FIG. 4 is a perspective action view showing the operation of the mainsail furling device of FIG. 1 with the mainsail being lowered.
Figure 5:
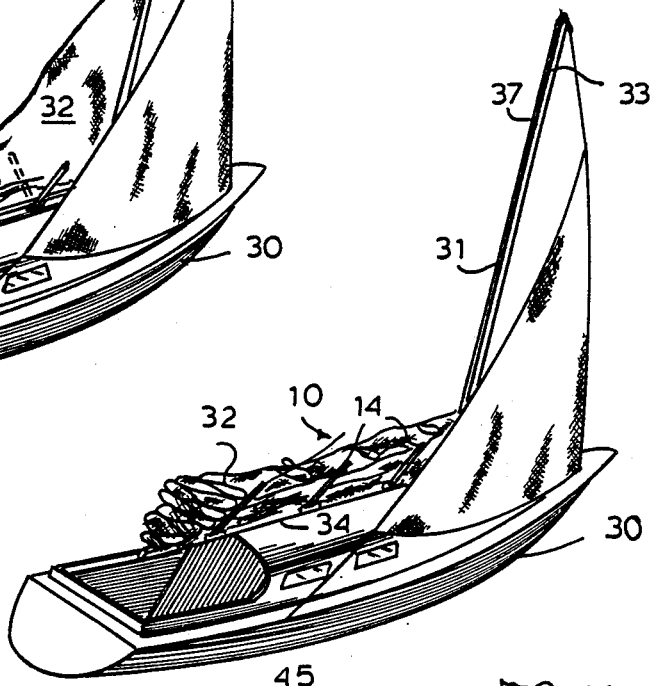
FIG. 5 is another perspective action view showing the operation of the mainsail furling device of FIG. 1 with the mainsail completely lowered and folded ready for a cover or tiedowns.

The mainsail furling device 10 shown in the drawing comprises three pairs of mounting brackets 12 attached to the boom 34 of a sloop 30 spaced from each other, a mainsail retaining arm 14 pivotally attached to each of the mounting brackets 12 pivotable between a position folded against the boom 34 and a deployed position substantially perpendicular to the boom 34, a means 23 for pivotally mounting each of the mainsail retaining arms 14 and means 26 for securing each of the mainsail retaining arms 14 in a position substantially perpendicular to the boom 34.

As shown in FIG. 3 each of the mounting brackets 12 has a substantially L-shaped cross section with two approximately rectangular bracket panels 12', 12'' connected to each other substantially perpendicularly. The shorter of the two bracket panels 12' has folded-under flange portion 20 with screw holes 15 for attaching the mounting bracket 12 nondetachably to the boom 34 adjacent the boom slot 36. The free end of the longer of the two bracket panels 12'' is attached to the boom 34 substantially parallel to the boom longitudinal direction permanently with fasteners 16 such as studs, rivets or the like or by drilling holes and using special permanent fastening means.

The length of the longer bracket panel 12'' is such that its surface is inclined outwardly from the boom 34 upwardly when the mounting bracket 12 is attached to the boom 34. The two mounting brackets 12 of a pair are attached on opposite sides of the boom 34 and are of course identical.

The mainsail retaining arm 14 comprises a substantially flat metal bar. The mainsail retaining arms 14 are of such a length that when they are extended upwardly and substantially perpendicularly to the boom 34 from each mounting bracket 12 of a pair of mounting brackets 12 they form a V-shaped cradle for the folded mainsail.

Figure 6:
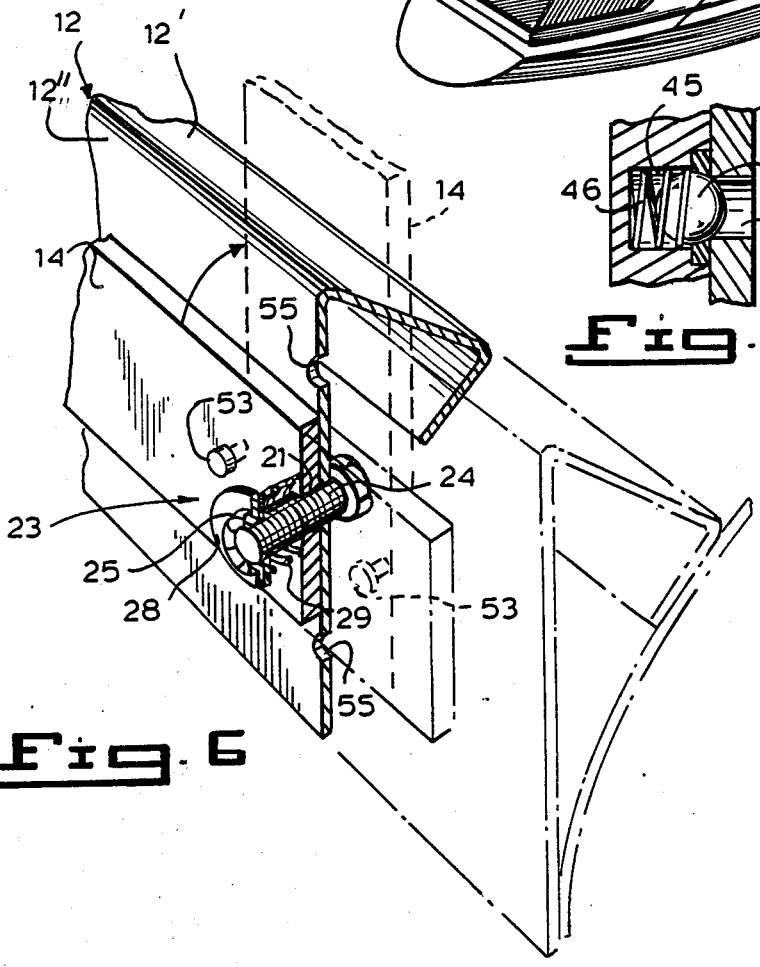
FIG. 6 is a perspective view showing details of attachment of a sail retaining arm to the mounting bracket of the mainsail furling device of FIG. 1.
Figure 8:
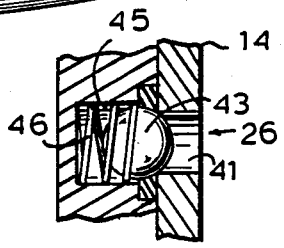
FIG. 8 is a cross sectional view of a portion 8 indicated with a dot-dashed circle in FIG. 7 showing the method of attachment of FIG. 7 in more detail.
Figure 7:
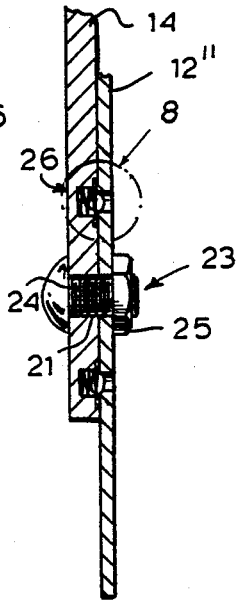
FIG. 7 is a cross sectional view of a different method of attachment of a sail retaining arm to the mounting bracket.

The means 23 for pivotally mounting each of the mainsail retaining arms 12 on each of the mounting brackets 12 in both the embodiments shown in FIGS. 6 through 8 is a threaded bolt 24 passing through a hole 21 in the bracket panel 12'' and in the mainsail retaining arm. In FIG. 6 the head of the threaded bolt 24 is located in the interior region between the boom 34 and the inner surface of the mounting bracket 12 and the threaded portion of the threaded bolt 24 protrudes outwardly from the mounting bracket 12. A nut 25 secures the threaded bolt 24 in placed and holds the mainsail retaining arm 14 flat against the bracket panel 12'' of the mounting bracket 12 as shown in FIG. 7. In the case of the embodiment of FIG. 6 a spring 29 is disposed between a locking washer 28 attached to the free end of the threaded bolt 24 protruding from the mounting bracket 12 and the outer surface of the mainsail retaining arm 14.

Two different means 26 for securing the outwardly and upwardly deployed mainsail retaining arm 14 of a mounting bracket 12 are shown in FIGS. 7 and 8 and in FIGS. 6 and 2. In the embodiment of FIGS. 7 and 8 the means 26 for securing the mainsail retaining arm 14 is a spring-loaded locking device comprising a ball hole 41 provided in the bracket panel 12'' and a spring-loaded ball 43 mounted in the mainsail retaining arm 14 whose diameter is larger than the diameter of the ball hole 41. The spring-loaded ball 43 is mounted in a cavity 45 in the mainsail retaining arm 14 loaded by the spring 46 and retained by the press-fit washer 48 in the surface of the arm. Nevertheless the hole in the washer 48 is large enough so that the spring-load ball 43 will protrude into the hole 41 in the bracket panel 12'' securing the arm in place when the mainsail retaining arm 14 is rotated into position. Of course the hole 41 and the cavity 45 must be positioned correctly so that they can come into coincidence when the arm is in the correct position substantially perpendicular to the boom 34. In this way in the embodiment corresponding to FIGS. 7 and 8 the mainsail retaining arms 14 of a mounting bracket pair lock in position when the V-shaped cradle for the sail is formed by extending them substantially perpendicularly to the boom 34.

The embodiment of FIG. 6 for the means 26 for securing the mainsail retaining arm 14 in position extended upwardly and outwardly is more complicated.

The means 23 for pivotally attaching the arm 14 has been described above and includes spring 29. The means 26 for securing the mainsail arm 14 in place comprises two catch pins 53 protruding somewhat through the mainsail retaining arm 14 which are spaced substantially equally from the means 23 for pivotal attachment in the longitudinal direction of the arm 14 on opposite sides of the means for pivotal attachment and two catch pin holes 55 in the bracket panel 12'' on opposite sides of the means 23 for pivotal attachment positioned to engage the catch pins 53 when the mainsail retaining arm 14 is in the correct position to assist in furling the mainsail 32.

The mainsail furling device 10 according to the instant invention operates as follows:

Before the mainsail 32 of the sloop 30 is stored temporarily using the invention the mainsail retaining arms 14 of each pair of mounting brackets 12 are folded against the boom 34 out of the way as shown by the solid lines in FIGS. 1 and 2. Then each of the mainsail retaining arms 14 is rotated upwardly using the means 23 for pivotal attachment until it is substantially perpendicular to the boom 34 and is locked in place using the means 26 for securing it. This configuration which is suitable to cradle or hold the folded mainsail 32 is shown with dashed lines in FIGS. 1 and 2.

After the mainsail retaining arms 14 have been appropriately deployed the main halyard 31 is eased and the mainsail 32 is lowered as shown in FIG. 4 folding it as it is lowered so that when it is down it is retained folded in the arms 14. However the headboard 39 of the mainsail 32 remains in the aft slot 37 of the mast 33 and the halyard 31 remains attached to the mainsail 32. Thus the mainsail 32 can be very quickly and easily raised once again and the mainsail retaining arms 14 can be folded back onto the boom 34.

The mounting bracket pairs in this embodiment are spaced approximately equally along the boom.

The stowed mainsail 32 in place on the mainsail furling device 10 can of course be provided with an acrylic cover when the sail is to be stowed on the boom for a period of from several hours to days as it would be at a mooring or in a slip.

LIST OF REFERENCE CHARACTERS

10 mainsail retaining device (the invention)
12 mounting bracket
12' bracket panel (shorter panel)
12'' bracket panel
14 mainsail retaining arm
15 screw holes
16 fastening means
20 folded-under flange portion
21 hole
23 means for pivotally mounting an arm 14
24 threaded bolt
25 nut
26 means for securing an arm 14
28 locking washer
29 spring
30 sloop
31 main halyard
32 mainsail
33 mast
34 boom
36 boom slot
37 aft slot (mast 33)
39 headboard
41 ball hole
43 spring-loaded ball
45 cavity
46 spring
48 washer
53 catch pin
55 catch pin hole It will be understood that each of the elements described above, or two or more together, may also find a useful application in other types of devices differing from the type described above.

While certain novel features of this invention have been shown and described and are pointed out in the annexed claims, it is not intended to be limited to the details above, since it will be understood that various omissions, modifications, substitutions and changes in the forms and details of the apparatus illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A mainsail furling device for a mainsail of a sailboat having a boom comprising a plurality of pairs of mounting brackets attached to said boom of said sailboat spaced from each other on said boom, each of said mounting brackets having a substantially L-shaped cross section and two approximately rectangular bracket panels containing a shorter bracket panel and a longer bracket panel and being connected to each other substantially perpendicularly, said shorter bracket panel having a folded-under flange portion with screw holes for securing said mounting bracket nondetachably to said boom and the free end of said longer bracket panel being attached nondetachably to said boom substantially parallel to the boom longitudinal direction, a mainsail retaining arm attached pivotally to each of said mounting brackets pivotable between a position folded against said boom and a deployed position substantially perpendicular to said boom, a means for pivotally mounting each of said mainsail retaining arms and a means for securing each of said mainsail retaining arms in said deployed position substantially perpendicular to said boom.

2. A mainsail furling device according to claim 1 in which said means of pivotally mounting said retaining arm on said mounting bracket comprises a threaded bolt passing through said longer bracket panel of said mounting bracket and the lower portion of said mainsail retaining arm and a nut engaged with said threaded bolt pressing said mainsail retaining arm on said mounting bracket.

3. A mainsail furling device according to claim 1 in which said means for securing said mainsail retaining arm in an upwardly extended position substantially perpendicular to said boom comprises at least one spring-loaded ball mounted in a cavity in said mainsail retaining arm and a ball hole or recess in said mounting bracket to receive a portion of said ball of said spring-loaded ball when said mainsail retaining arm is pivoted into said upwardly extended position.

4. A mainsail furling device according to claim 1 in which said means for securing said mainsail retaining arm in an upwardly extended position substantially perpendicular to said boom comprises two catch pin holes provided in said mounting bracket on opposite sides of said means for pivotal mounting of said mainsail retaining arm and two catch pins protruding through said mainsail retaining arm on opposite sides of said means for pivotal mounting positioned to engage said catch pin holes when said mainsail retaining arm is in said upwardly extended position.

5. A mainsail furling device for a mainsail of a sailboat having a boom comprising:

three pairs of mounting brackets attached to said boom of said sailboat spaced equally along said boom, said mounting brackets having a substantially L-shaped cross section and two connected approximately rectangular bracket panels, the shorter of said two bracket panels having a folded-under flange portion with screw holes for securing said mounting bracket nondetachably to said boom;

a mainsail retaining arm pivotally attached to each of said mounting brackets pivotable between a position folded against said boom and a deployed position substantially perpendicular to said boom;

a means for pivotally mounting each of said mainsail retaining arms on said mounting bracket comprising a threaded bolt passing through said longer bracket panel of said mounting bracket and the lower portion of said sail retaining arm and a nut engaged with said threaded bolt pressing said mainsail retaining arm on said mounting bracket; and a means for securing each of said mainsail retaining arms in a position substantially perpendicular to said boom comprising at least one spring-loaded ball mounted in a cavity in said mainsail retaining arm and a ball hole in said mounting bracket positioned to receive a portion of said ball of said spring-loaded ball when said mainsail retaining arm is pivoted into said upwardly extended position.

* * * * *